United States Patent [19]

Rodgers

[11] 4,428,536

[45] Jan. 31, 1984

[54] PULVERIZING AND CLASSIFYING MILL

[75] Inventor: Jeffrey C. Rodgers, Hoylandswaine, England

[73] Assignee: British Rema Manufacturing Co., Limited, England

[21] Appl. No.: 202,355

[22] Filed: Oct. 25, 1980

[30] Foreign Application Priority Data

Oct. 30, 1979 [GB] United Kingdom ..... 7937566

[51] Int. Cl.[3] ..... B02C 13/284; B02C 13/286; B02C 23/12

[52] U.S. Cl. ..... 241/52; 241/73; 241/80; 241/154; 241/188 R

[58] Field of Search ..... 241/49, 51, 52, 56, 241/57, 59, 73, 74, 80, 97, 257 R, 154, 258, 191, 195, 188 R

[56] References Cited

U.S. PATENT DOCUMENTS 2,546,860 3/1951 Klagsbrunn ..... 241/188 R X 3,490,704 1/1970 Bourne et al. ..... 241/154

*Primary Examiner*—Mark Rosenbaum

*Assistant Examiner*—Timothy V. Eley

*Attorney, Agent, or Firm*—King and Liles

[57] ABSTRACT

A classifier mill having first and second series of beaters (1, 2) on respective sides (3, 4) of the periphery (5) of a rotary pulverizer disc (6) within a chamber (7), an independently rotary classifier (8) coaxial therewith and radially inwards of the second series of beaters (2), an entry (9) for material into the chamber (7) at a position intermediate the pulverizer axis and the first series of beaters (1), and an exit (10) for fines coaxial with the classifier (8) and remote from the pulverizer (6), is further provided within the chamber (7) with an annular wall (18) extending radially outwards from clear of the periphery (19) of the classifier (8) to beyond the periphery (5) of the second series of beaters (2), and with a cylindrical wall (20) extending from the annular wall (18) past the peripheries of both series of beaters (1, 2), the cylindrical wall (20) being provided with a series of circumferentially spaced openings (21) disposed radially outwards with respect to only the first series of beaters (1), which openings (21) may be provided with screens (22).

6 Claims, 3 Drawing Figures

PULVERIZING AND CLASSIFYING MILL

Figure 1:
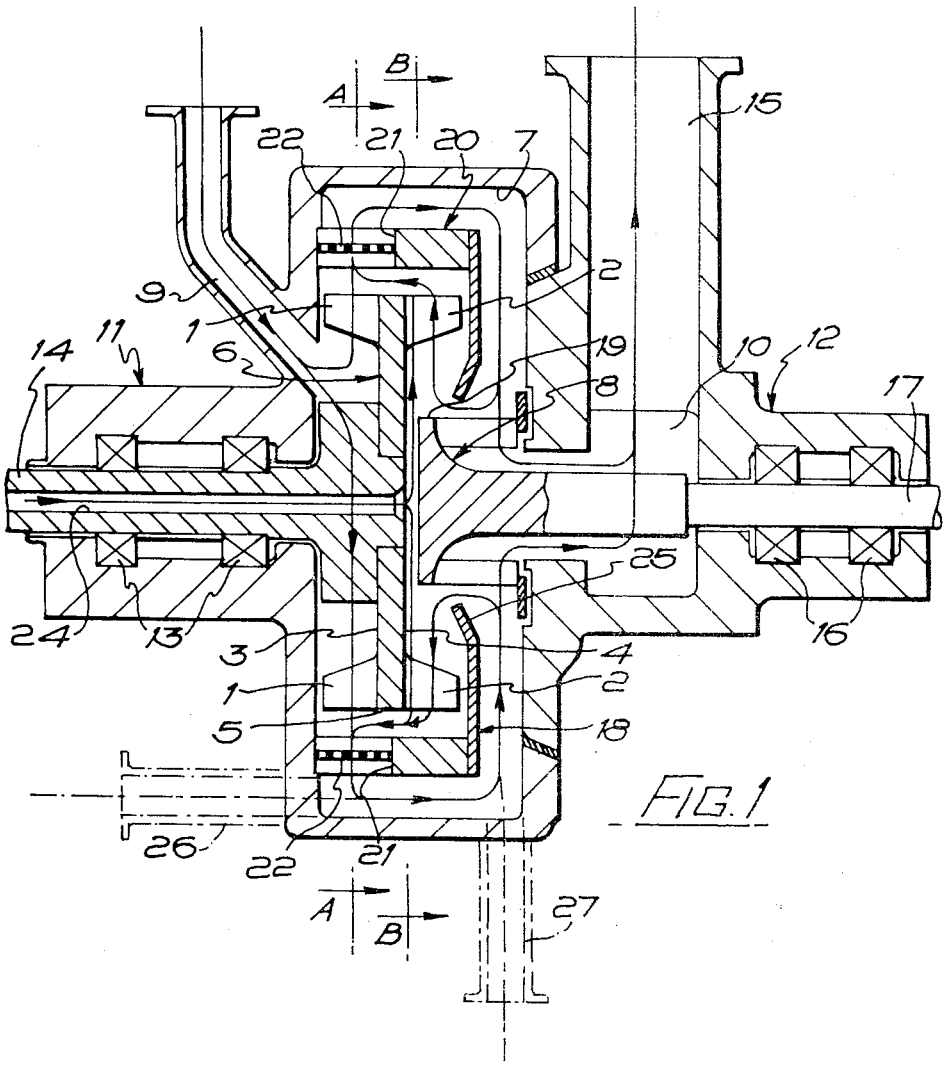

This invention relates to mills for the pulverizing of raw materials, such as ores, rocks, chemicals, foods and pharmaceuticals, and particularly of the type incorporating a rotary classifier.

It is known to provide a mill of this type in which beaters are mounted around the periphery of a rotary pulverizer disc within a chamber, with first and second series of beaters on respective sides of the periphery of the disc, and with an independently rotary classifier coaxial with the pulverizer disc and disposed radially inwards in relation to the second series of beaters on the adjacent side of the disc, an entry for material to be pulverized being provided into the chamber at a position intermediate the axis of the pulverizer disc and the first series of beaters on the side remote from the classifier, and an exit for the removal of fines being provided coaxially with the classifier and remote from the pulverizer. Such a mill will be referred to hereinafter as "a classifier mill of the type defined."

The disadvantages of a classifier mill of the type defined are that all material to be pulverized passes radially outwards through the first series of beaters, axially around the periphery of the pulverizer disc, and radially inwards through the second series of beaters to reach the classifier, so that pulverized material rejected by centrifugal force at the classifier and returned towards the second series of beaters is trying to move against the initial flow of all the material, and that the returned material reaching the second series of beaters, is unlikely to undergo any appreciably more pulverizing than when it first passed (radially inwards) through the second series of beaters.

The object of the present invention is to provide a classifier mill of the type defined in which the above disadvantages are overcome.

According to the present invention, a classifier mill of the type defined has within the chamber an annular wall extending radially outwards from clear of the periphery of the classifier to beyond the periphery of the second series of beaters of the pulverizer, and a cylindrical wall extending from the annular wall axially past the peripheries of both series of beaters, the cylindrical wall being provided with a series of circumferentially spaced openings disposed radially outwards with respect to only the first series of beaters.

Thus, material to be pulverized passes, upon entering the chamber, radially outwards through the first series of beaters, is pulverized between the first series of beaters and the portions of the cylindrical wall between the openings in that wall, passes radially outwards through the openings in the cylindrical wall, then moves axially between the outside of the clyindrical wall and the inside of the chamber wall, and next moves radially inwards to the classifier, where fines pass through the classifier to the exit, while material rejected by centrifugal force at the classifier passes radially outwards between the annular wall and the disc of the pulverizer and radially outwards through the second series of beaters, is further pulverized between the second series of beaters and the continuous portion of the cylindrical wall, along which the further pulverized material passes axially until it can pass radially outwards through the openings in the cylindrical wall and continue as before to the classifier, through which it passes to the exit.

Therefore, with a classifier mill in accordance with the present invention, none of the material being pulverized moves against the general flow. Material only comes into contact with the second series of beaters after classification has occurred. In other words, only material rejected by the classifier passes to the second series of beaters. Furthermore, less power is needed to attain the same degree of pulverizing as with the prior art classifier mill, and the division of the pulverizer into two distinct sections allows some control of the degree of pulverization, in addition to that afforded by adjusting the relative speeds of the pulverizer and the classifier.

The openings in the cylindrical wall may be provided with screens, which ensure that material to be pulverized does not pass unpulverized straight through the first series of beaters and the openings, and which also enable a first degree of pulverizing to be controlled, i.e., classified.

The flow of material is assisted by air flow induced through the entry for the material by the fan action of the pulverizer, and by suction applied to the exit. However, the flow of material (particularly through the second series of beaters) may be assisted by air supplied under pressure through an axial bore through a shaft for the pulverizer, the air from the bore being directed radially outwards between the pulverizer disc and the adjacent end of the classifier. The annular wall may have an inner portion inclined radially inwards towards the pulverizer disc, so as to assist in directing air flow to the second series of beaters.

In certain circumstances it may be desirable to effect some cooling between the pulverizing and classification stages. Alternatively, or in addition, if pulverizing is carried out against a relatively fine screen in the cylindrical wall the essential airflow through the pulverizer and classifier may become restricted, which would reduce the efficiency of the classifier and which would increase the operating temperature of the mill unnecessarily.

The necessary rate of flow of air could be restored by increasing suction at the fines outlet, but this would increase the power requirement of the mill.

Therefore, the mill may be provided with an additional inlet in the side or in the peripheral wall of the chamber at a position radially or axially respectively beyond the cylindrical wall, so that additional air could be introduced to effect interstage cooling and/or to ensure the requisite rate of flow of air to the classifier. The additional inlet could also be used to add feed material already of small particle size, or to add different feed material for mixing.

Figure 2:
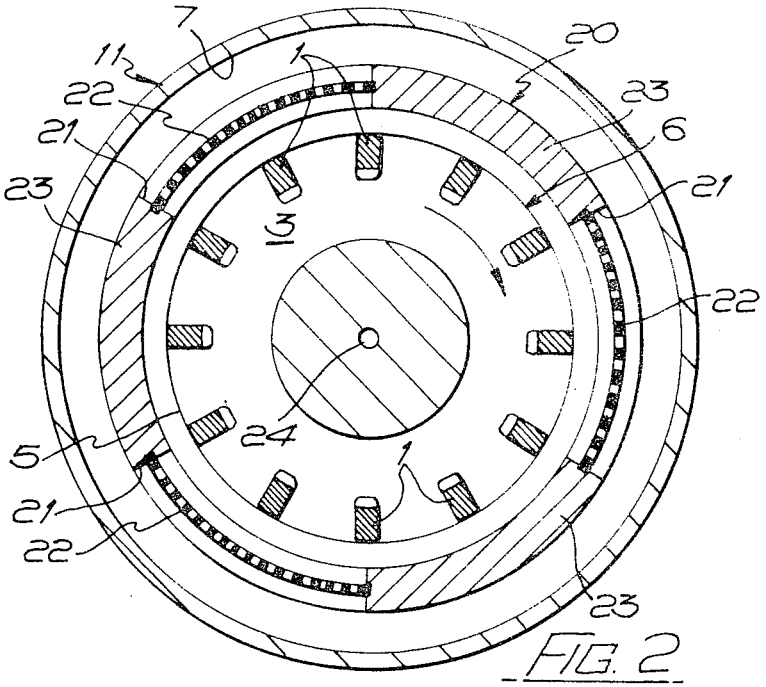
Figure 3:
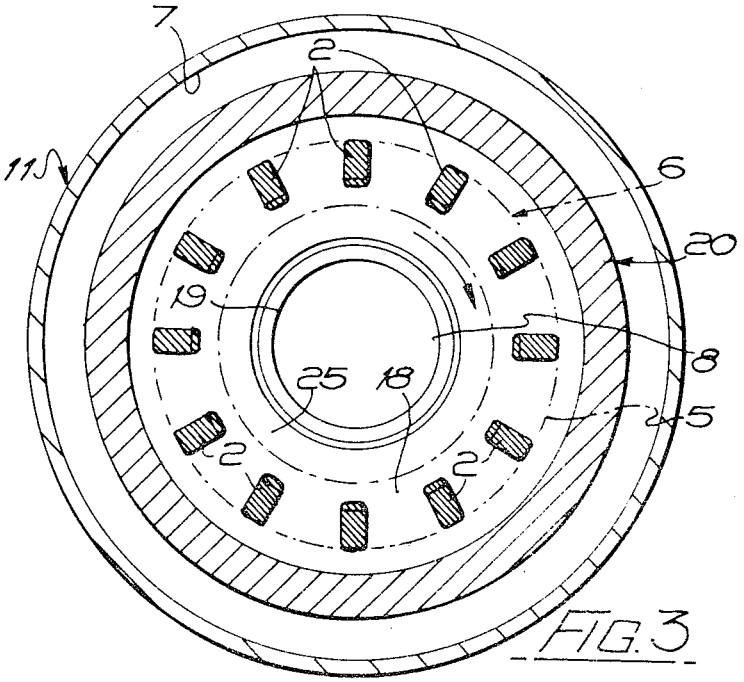

An embodiment of the invention will now be described, by way of example only, with reference to the accompanying drawings, in which:

FIG. 1 is a diagrammatic axial section through a classifier mill in accordance with the invention; and FIGS. 2 and 3 are sections from the lines A—A and B—B respectively in FIG. 1.

In the classifier mill shown in the drawings, the first and second series of beaters 1, 2 are mounted on respective sides 3, 4 around the periphery 5 of a rotary pulverizer disc 6, within a chamber 7, and an independently rotary classifier 8 is provided coaxial with the pulverizer disc 6 and disposed radially inwards in relation to the second series of beaters 2 on the adjacent side 4 of the disc 6, an entry 9 for material to be pulverized being provided into the chamber 7 at a position intermediate the axis of the pulverizer disc 6 and the first series of beaters 1 on the side 3 remote from the classifier 8, and an exit 10 for the removal of fines being provided coaxially with the classifier 8 and remote from the pulverizer 6.

The chamber 7 is formed between two main casing units 11, 12 respectively, the casing unit 11 being provided with the entry 9 (for the material to be pulverized) and bearings 13 for a shaft 14 carrying the pulverizer disc 6, and the casing unit 12 being provided with the exit 10 (for the removal of fines) and a discharge duct 15 and also bearings 16 for a shaft 17 carrying the classifier 8. Drive units, consisting of motors and reduction drives, for the shafts 14, 17 are not shown in the drawings.

In accordance with the invention, the chamber 7 is provided with an annular wall 18 extending radially outwards from clear of the periphery 19 of the classifier 8 to beyond the periphery 5 of the second series of beaters 2 of the pulverizer 6, and a cylindrical wall 20 extends from the annular wall 18 axially past the peripheries of both series of beaters 1, 2, the cylindrical wall 20 being provided with a series of three circumferentially spaced openings 21 disposed radially outwards with respect to only the first series of beaters 1. The openings 21 are provided with screens 22, which ensure that material to be pulverized does not pass unpulverized straight through the first series of beaters 1 and through the openings 22, and which also enable a first degree of pulverizing to be controlled, i.e., classified.

The clearance between the periphery 5 of the pulverizer 6 and the inside of the cylindrical wall 20 has been somewhat exaggerated to enable the flow paths therebetween to be clearly marked by arrowed lines.

Material to be pulverized passes, upon entering the chamber 7 through the entry 9, radially outwards through the first series of beaters 1, is pulverized between the beaters 1 and the portions 23 (FIG. 2 only) of the cylindrical wall 20 between the openings 21 in that wall, passes radially outwards through the screens 22 in the openings 21, then moves axially between the outside of the cylindrical wall and the inside of the chamber wall, and next moves radially inwards to the classifier 8, where fines pass through the classifier to the exit 10, while material rejected by centrifugal force at the classifier 8 passes radially outwards between the annular wall 18 and the pulverizer disc 6 and radially outwards through the second series of beaters 2, is further pulverized between the beaters 2 and the continuous portion of the cylindrical wall 20 (see especially FIG. 3), along which the further pulverized material passes axially until it can pass radially outwards through the screens 22 in the openings 21 in the cylindrical wall and continue as before to the classifier 8, through which it passes to the exit 10.

The flow of material is assisted by air flow induced through the entry 9 for the material by the fan action of the pulverizer 6, and by suction applied to the exit 10 through the discharge duct 15 by means not shown. However, the flow of material through the second series of beaters 2 is assisted by air supplied under pressure (by means not shown) through an axial bore 24 through the shaft 14 for the pulverizer 6, the air from the bore 24 being directed radially outwards between the pulverizer disc 6 and the adjacent end of the classifier 8. The annular wall 18 has an inner portion 25 inclined radially inwards towards the pulverizer disc 6, so as to assist in directing air flow to the second series of beaters 2.

As indicated by broken lines in FIG. 1 only, an additional inlet 26 or 27 may be provided in the side or in the peripheral wall of the chamber 7 at a position radially or axially respectively beyond the cylindrical wall 20, so that additional air could be introduced to effect interstage cooling and/or to ensure the requisite rate of flow of air to the classifier 8. The additional inlet 26 or 27 could also be used to add feed material already of small particle size, or to add different feed material for mixing.

What I claim is:

1. A classifier mill comprising a casing, beaters disposed within said casing mounted about a periphery of a rotary pulverizer disc within a chamber of the casing, with first and second series of beaters on respective sides of the periphery of the disc, and with an independently rotary classifier coaxial with the pulverizer disc and disposed radially inwards in relation to the second series of beaters on an adjacent side of the disc, an entry for material to be pulverized being provided into the chamber at a position intermediate the axis of the pulverizer disc and the first series of beaters on the side remote from the classifier, and an exit for the removal of fines being provided coaxially with the classifier and remote from the pulverizer, an annular wall disposed within the chamber extending radially outwards from clear of the periphery of the classifier to a position intermediate the periphery of the second series of beaters of the pulverizer and the casing, and a cylindrical wall extending from the annular wall axially within the casing past the peripheries of both series of beaters, the cylindrical wall being provided with a series of circumferentially spaced screening means disposed radially outwards with respect to only the first series of beaters and communicating with a flow passage within the casing partially defined by the annular and cylindrical walls, the flow passage extending radially inward to the classifier and being isolated from the second series of beaters, the classifier being operative to direct only selective components of a material pulverized by the first series of beaters to the second series of beaters.

2. A classifier mill as in claim 1, wherein the screening means includes openings in the cylindrical wall, each opening being provided with a screen.

3. A classifier mill as in claim 1, wherein a shaft is provided for the pulverizer, with an axial bore through the shaft, and wherein means is provided for applying air under pressure through the bore to be directed radially outwards between the pulverizer disc and the adjacent end of the classifier.

4. A classifier mill as in claim 3, wherein the annular wall has an inner portion inclined radially inwards towards the pulverizer disc, so as to assist in directing air flow to the second series of beaters.

5. A classifier mill as in claim 1, provided with an additional inlet in the side of the chamber at a position radially beyond the cylindrical wall.

6. A classifier mill as in claim 1, provided with an additional inlet in the peripheral wall of the chamber at a position axially beyond the cylindrical wall.

* * * * *

UNITED STATES PATENT AND TRADEMARK OFFICE

CERTIFICATE OF CORRECTION

PATENT NO. : 4,428,536

DATED : January 31, 1984

INVENTOR(S) : Jeffrey C. Rodgers

It is certified that error appears in the above-identified patent and that said Letters Patent is hereby corrected as shown below:

On the title page,"Item [22] Filed: Oct. 25, 1980" should read -- Item [22] Filed: Oct. 28, 1980 --.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*